US009199471B2

(12) United States Patent
Shibata et al.

(10) Patent No.: US 9,199,471 B2
(45) Date of Patent: Dec. 1, 2015

(54) LIQUID DISCHARGE APPARATUS

(71) Applicant: SEIKO EPSON CORPORATION, Tokyo (JP)

(72) Inventors: Yohei Shibata, Matsumoto (JP); Kazutoshi Fujisawa, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/223,036

(22) Filed: Mar. 24, 2014

(65) Prior Publication Data

US 2014/0292920 A1 Oct. 2, 2014

(30) Foreign Application Priority Data

Mar. 28, 2013 (JP) ..... 2013-068276

(51) Int. Cl.
*B41J 2/17* (2006.01)
*B41J 29/02* (2006.01)
*B41J 29/377* (2006.01)

(52) U.S. Cl.
CPC ..... *B41J 2/1714* (2013.01); *B41J 29/02* (2013.01); *B41J 29/377* (2013.01)

(58) Field of Classification Search
USPC ..... 347/34
See application file for complete search history.

(56) References Cited

U.S. PATENT DOCUMENTS 5,774,141 A * 6/1998 Cooper et al. ..... 347/34
2009/0207223 A1* 8/2009 Cofler et al. ..... 347/102
2012/0001991 A1* 1/2012 Onozawa et al. ..... 347/102

FOREIGN PATENT DOCUMENTS

JP 2010-000735 1/2010
JP 2010-058441 3/2010
JP 2011-143657 7/2011
JP 2012-187583 10/2012

* cited by examiner

*Primary Examiner* — Manish S Shah
*Assistant Examiner* — Renee I Wilson
(74) *Attorney, Agent, or Firm* — Workman Nydegger

(57) ABSTRACT

Provided is a liquid discharge apparatus including a recording unit that discharges an ink, an UV irradiation unit that has an intake port, an exhaust port, an internal flow path which is communicated with the intake port and the exhaust port, and a filter which catches the ink, and an X axis movement section that supports the recording unit and the UV irradiation unit, and moves the recording unit and the UV irradiation unit in an X axis direction, in which the UV irradiation unit is supported by the X axis movement section on a rear side, and the exhaust port faces a front side.

7 Claims, 10 Drawing Sheets

LIQUID DISCHARGE APPARATUS

BACKGROUND

1. Technical Field

The present invention relates to a liquid discharge apparatus that discharges a liquid onto a medium.

2. Related Art

In the related art, an ink jet printing apparatus that includes a head unit having a recording head, and a head scanning mechanism which supports the head unit on a back side and makes the head unit to reciprocate along a head scanning direction, is known as a liquid discharge apparatus of this type (see JP-A-2012-187583). The head unit has the recording head that discharges a UV ink downward, a carriage that arranges the recording head, and a light source unit that is arranged in a position adjacent to an end portion of the carriage in the head scanning direction, respectively. The light source unit has plural LEDs that irradiate with the UV downward, a heat sink of a fin type that absorbs and diffuses a heat which is emitted from the LED, a filter that is wound around a side surface of the heat sink and adsorbs an ink mist through which air passes, and a cooling fan that sucks the air on the heat sink and exhausts the air upward. When the cooling fan is driven, the air containing the ink mist is sucked from a duct which is arranged in the carriage, and is exhausted upward through the filter and the heat sink. In this manner, the cooling fan for cooling the LED is also used to remove the ink mist.

However, in the liquid discharge apparatus of the related art, due to a configuration in which an exhaust of the light source unit goes out upward, there is a concern that the exhaust from the light source unit reaches a head movement mechanism which is positioned on the back side of the light source unit. Therefore, there are problems that particles of the ink which is not adsorbed (caught) by the filter are attached to the head scanning mechanism, riding on the exhaust, and a defect is caused in the head scanning mechanism.

SUMMARY

An advantage of some aspects of the invention is to provide a liquid discharge apparatus that can prevent an exhaust from an intake and exhaust section from reaching a movement section which moves the liquid discharge section.

According to an aspect of the invention, there is provided a liquid discharge apparatus including a liquid discharge section that discharges a liquid, an intake and exhaust section that has an intake port, an exhaust port, a flow path which is communicated with the intake port and the exhaust port, and a filter which catches the liquid, and a movement section that supports the liquid discharge section and the intake and exhaust section, and moves the liquid discharge section and the intake and exhaust section in a first direction, in which the intake and exhaust section is supported by the movement section on one side in a second direction which is orthogonal to the first direction, and the exhaust port faces the other side which is opposite to the one side in the second direction.

In this case, the intake and exhaust section is supported by the movement section on the one side in the second direction, and the exhaust port of the intake and exhaust section faces the other side in the second direction. Thereby, it is possible to prevent the exhaust from the intake and exhaust section from reaching the movement section. Accordingly, it is possible to exceedingly avoid attaching particles of the liquid which is not caught by the filter to the movement section, riding on the exhaust. Therefore, it is possible to prevent a defect from occurring in the movement section by the attaching of the liquid.

In the liquid discharge apparatus, it is preferable that the intake port is arranged in an upper portion of the intake and exhaust section, and arranged to be inclined with respect to a horizontal surface.

In this case, an air flow that flows to the intake port which is arranged in the upper portion from the exhaust port facing the other side in the second direction, is generated. That is, by generating the air flow which circulates on the other side, it is possible to exceedingly avoid flowing an atmosphere containing a mist of the liquid into the movement section side (one side in the second direction). Accordingly, it is possible to effectively prevent the particles of the liquid from attaching to the movement section.

In the liquid discharge apparatus, it is preferable that the filter is obliquely arranged in accordance with the intake port.

In this case, since the filter is obliquely arranged in accordance with the intake port, it is possible to effectively catch the mist of the liquid.

In the liquid discharge apparatus, it is preferable that the intake and exhaust section has a liquid receiving section that receives the liquid which is discharged from a lower end portion in a vertical direction of the filter.

In this case, the liquid is caught by the filter, the liquid is pooled at the filter, the pooled liquid is collected in the lower end portion of the filter, and then, the liquid reaches the liquid receiving section. Since the liquid is stored in the liquid receiving section in this manner, there is no possibility that the filter is saturated with the liquid. Accordingly, it is possible to reduce an exchange frequency of the filter or a cleaning frequency of the filter.

In the liquid discharge apparatus, it is preferable that the liquid discharge section discharges the liquid of an electromagnetic wave curing type onto a medium, the intake and exhaust section has an electromagnetic wave irradiation section that irradiates with the electromagnetic wave the liquid which is discharged onto the medium, and a heat sink that cools the electromagnetic wave irradiation section, and the heat sink is arranged between the filter and the exhaust port in the flow path.

In this case, the atmosphere is sucked from the intake port, and is exhausted from the exhaust port, through the filter and the heat sink. Therefore, the air flow along with an intake and an exhaust of the intake and exhaust section can be used to cool the heat sink. It is possible to cool an energy line irradiation section.

In the liquid discharge apparatus, it is preferable that the intake and exhaust sections are included on one side and the other side of the liquid discharge section in the first direction, the two intake and exhaust sections include a fan configured to be capable of switching between a normal rotation drive that generates an air flow in a forward direction in an intake and an exhaust and a reverse rotation drive that generates the air flow in a reverse direction in the intake and the exhaust, respectively, and the two fans switch between the normal rotation drive and the reverse rotation drive so as to drive the fan of the intake and exhaust section which is positioned on a front side than the liquid discharge section in the first direction in a normal rotation manner, and the fan of the intake and exhaust section which is positioned on a rear side than the liquid discharge section in the first direction in a reverse rotation manner, along with switching of the movement between to the one side and to the other side in the first direction of the liquid discharge section.

In this case, by switching between the normal rotation drive and the reverse rotation drive of each fan along with the switching of movement direction in a reciprocation of the liquid discharge section, it is possible to catch the mist of the liquid more largely. For example, since inlets which are used for the intake are different from each other in the intake and exhaust section of the front side of the liquid discharge section and the intake and exhaust section of the rear side of the liquid discharge section, it is possible to suck the atmosphere in a wider range, and catch the mist of the liquid more largely.

In the liquid discharge apparatus, it is preferable that the filter has a first filter which is arranged in the intake port, and a second filter which is arranged in the exhaust port, and the intake and exhaust section has a first liquid receiving section that receives the liquid which is discharged from the lower end portion in the vertical direction of the first filter, and a second liquid receiving section that receives the liquid which is discharged from the lower end portion in the vertical direction of the second filter.

In this case, by arranging the filters in each of the intake port and the exhaust port, it is possible to catch the mist of the liquid at an upper stream end of the air flow (the air flow in the forward direction and the air flow in the reverse direction), regardless of the normal rotation drive and the reverse rotation drive of the fan. Furthermore, since the liquid that is pooled at each filter reaches the liquid receiving section, there is no possibility that each filter is saturated with the liquid. Accordingly, it is possible to reduce the exchange frequency of the filter or the cleaning frequency of the filter.

It is preferable that the liquid discharge apparatus further includes a control section that switches between a first mode which performs a liquid discharge operation to discharge the liquid from the liquid discharge section and an intake and exhaust operation to drive the intake and exhaust section, and a second mode which does not perform the liquid discharge operation and performs the intake and exhaust operation.

In this case, since the second mode which performs the intake and exhaust operation without performing the liquid discharge operation is included, even when it is not necessary to perform the liquid discharge operation, it is possible to recover the mist of the liquid.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
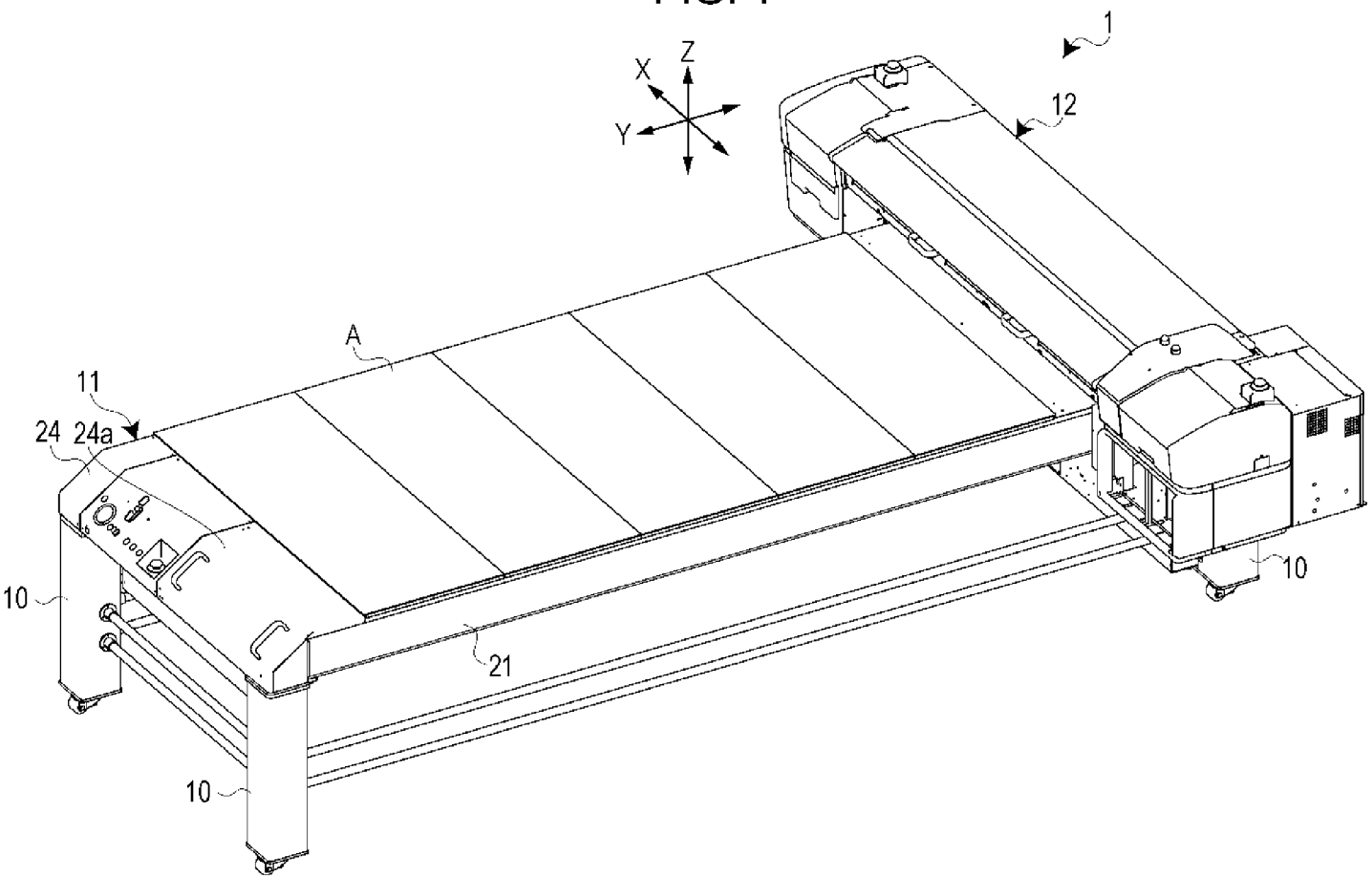
FIG. 1 is an external perspective view illustrating a recording apparatus according to an embodiment.

Hereinafter, a liquid discharge apparatus according to an embodiment of the invention will be described, with reference to the accompanying drawings. In the embodiment, a recording apparatus to which the liquid discharge apparatus according to the invention is applied, is used as an example. The recording apparatus records a desired image onto a recording medium (medium), by discharging a UV curable ink (liquid of an electromagnetic wave curing type) in an ink jet manner. Furthermore, the recording apparatus is a so-called flat bed type recording apparatus that performs the recording by moving a recording head with respect to the recording medium which is supported by a support stage. As a recording medium, for example, the recording medium having a different thickness such as a cardboard, a wood, a tile, a plastic board, a styrene board and a corrugated cardboard, is assumed. As shown in the drawings, an X axis (left and right) direction, a Y axis (front and rear) direction, and a Z axis (upper and lower) direction are defined and will be described later. Furthermore, the X axis direction and the Y axis direction are horizontal directions, and the Z axis direction is a vertical direction. Moreover, a near side of FIG. 1 is assumed as a front side of the recording apparatus, and a far side of FIG. 1 is assumed as a rear side of the recording apparatus.

Figure 2A:
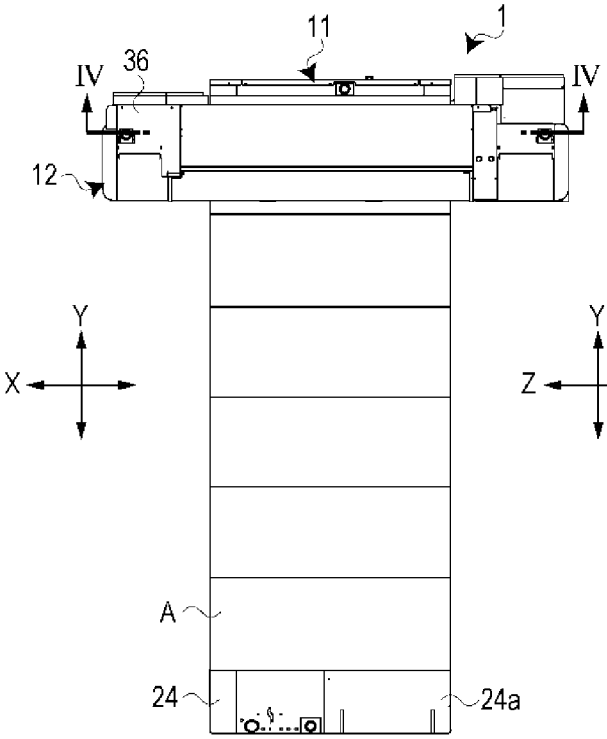
FIG. 2A is a plan view illustrating the recording apparatus.
Figure 2C:
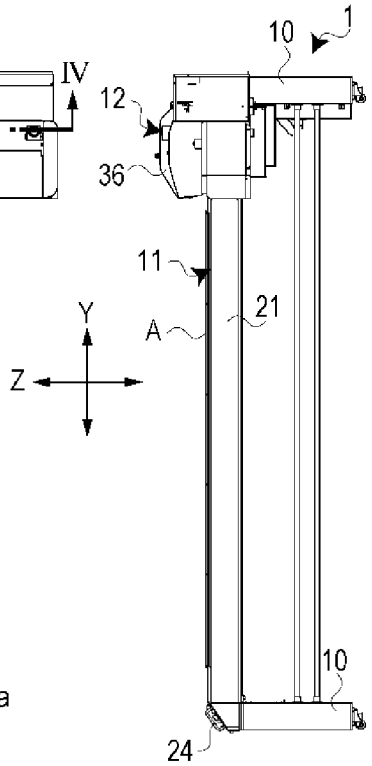
FIG. 2C is a side view illustrating the recording apparatus.
Figure 2B:
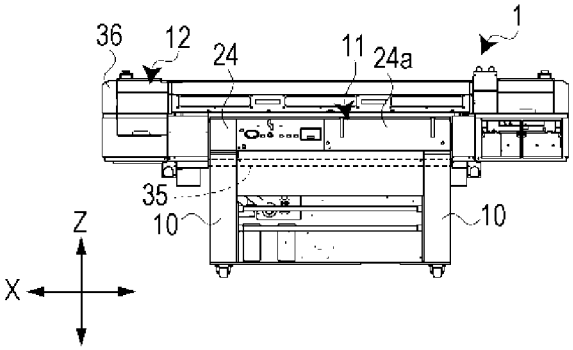
FIG. 2B is a front view illustrating the recording apparatus.
Figure 3:
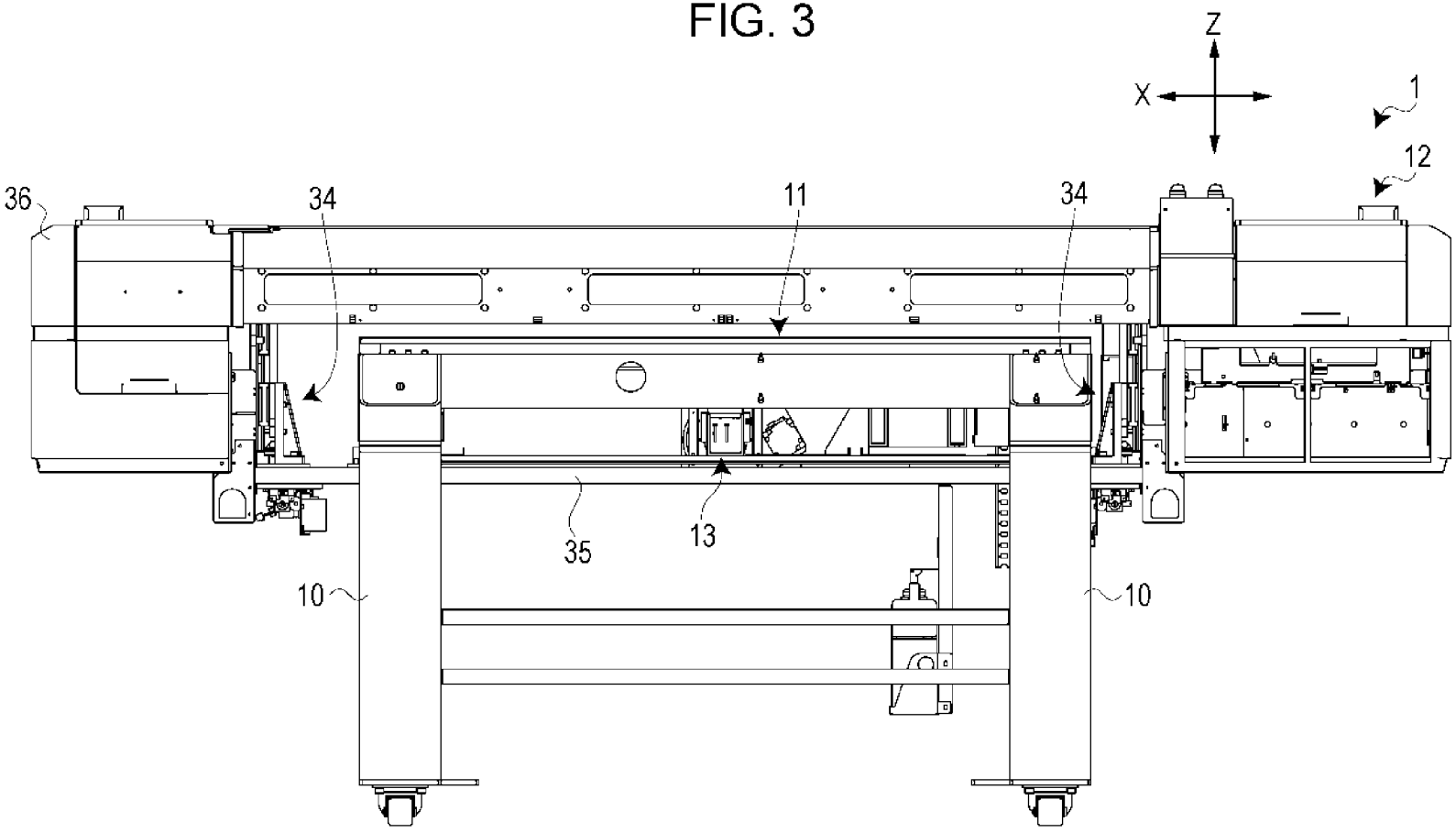
FIG. 3 is a front view illustrating the recording apparatus that excludes a portion of a support stage and a portion of an apparatus cover.

As shown in FIG. 1 to FIG. 3, a recording apparatus 1 is supported by four leg members 10. The recording apparatus 1 includes a support stage 11 that supports a recording medium A, a recording processing section 12 that has a head unit 31 confronting the supported recording medium A, a Y axis movement section 13 that supports the recording processing section 12 and moves the recording processing section 12 in the Y axis direction (second direction) with respect to the support stage 11, and a control unit 14 that controls each section (see FIG. 10). The recording processing section 12 is arranged so as to cross over the support stage 11 in the X axis direction (first direction). On the other hand, the Y axis movement section 13 is arranged to overlap with the support stage 11 on a back side (surface of a side opposite to the recording processing section 12 side) of the support stage 11. The Y axis movement section 13 movably supports the recording processing section 12 on the back side of the support stage 11.

Figure 4:
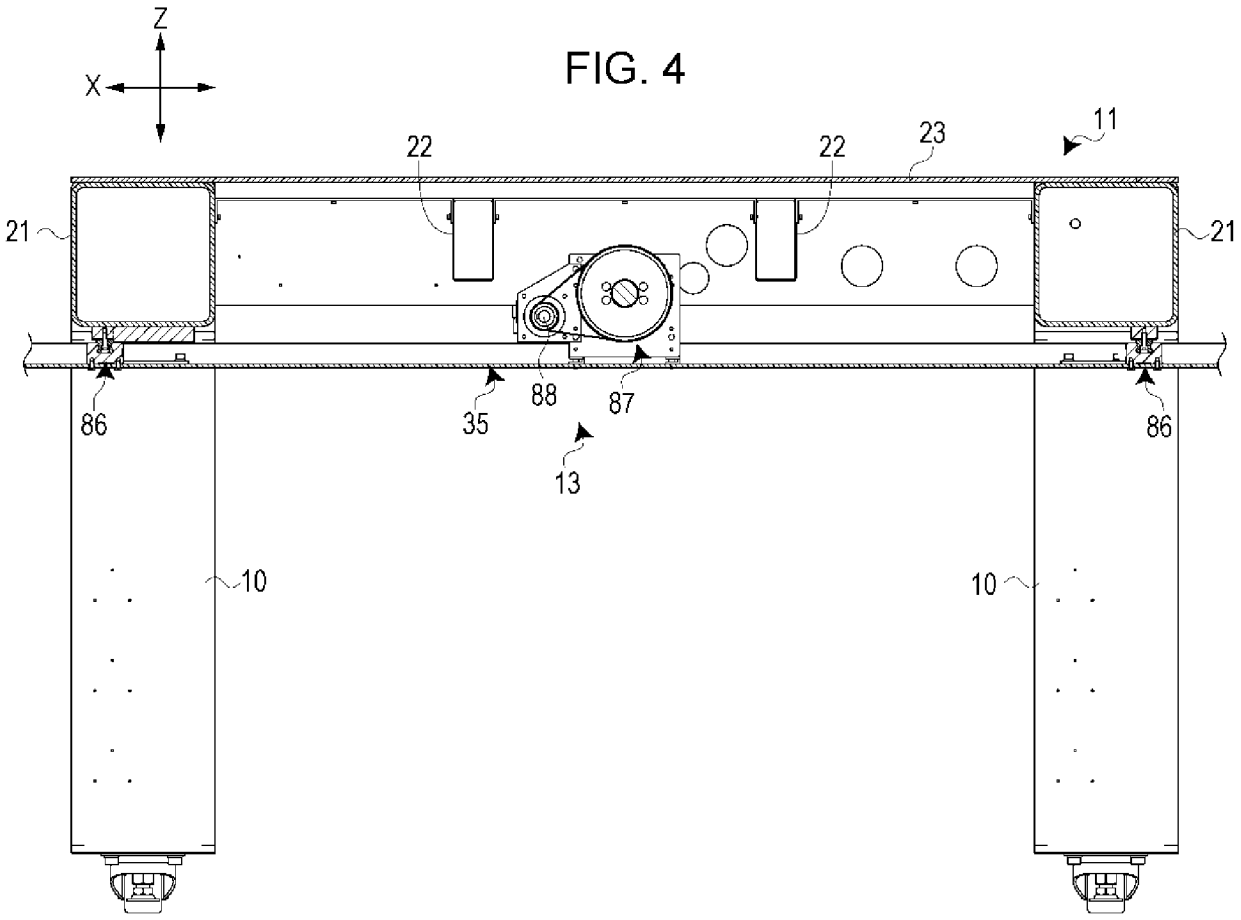
FIG. 4 is a sectional view illustrating the support stage and the vicinity of a Y axis movement section taken along the line IV-IV.

Next, referring to FIG. 1, FIG. 2A to FIG. 2C and FIG. 4, the support stage 11 will be described. FIG. 4 is a sectional view taken along the line IV-IV when seen the support stage 11 and the vicinity of the Y axis movement section 13 from the rear side thereof. As shown FIG. 1, FIG. 2A to FIG. 2C and FIG. 4, the support stage 11 includes a pair of left and right structure formation members 21 having beam shape that are extended in the Y axis direction, plural support members 22 that are arranged in all directions between the pair of the left and right structure formation members 21, and an adsorption table 23 that is supported by the pair of the left and right structure formation members 21 and the plural support members 22 and set to adsorb the recording medium A. An end portion of each left and right structure formation members 21 is connected to the leg members 10 by welding or the like, respectively. Furthermore, an operation panel section 24 is arranged in a front end portion of the support stage 11. Moreover, an open and close door 24*a* is widely arranged in a right half portion of the operation panel section 24. When maintenance of the recording processing section 12 is performed manually, the recording processing section 12 is moved to the near side (front side), the open and close door 24*a* is opened, and the maintenance of the recording processing section 12 is performed from the open and close door 24*a*.

Figure 5:
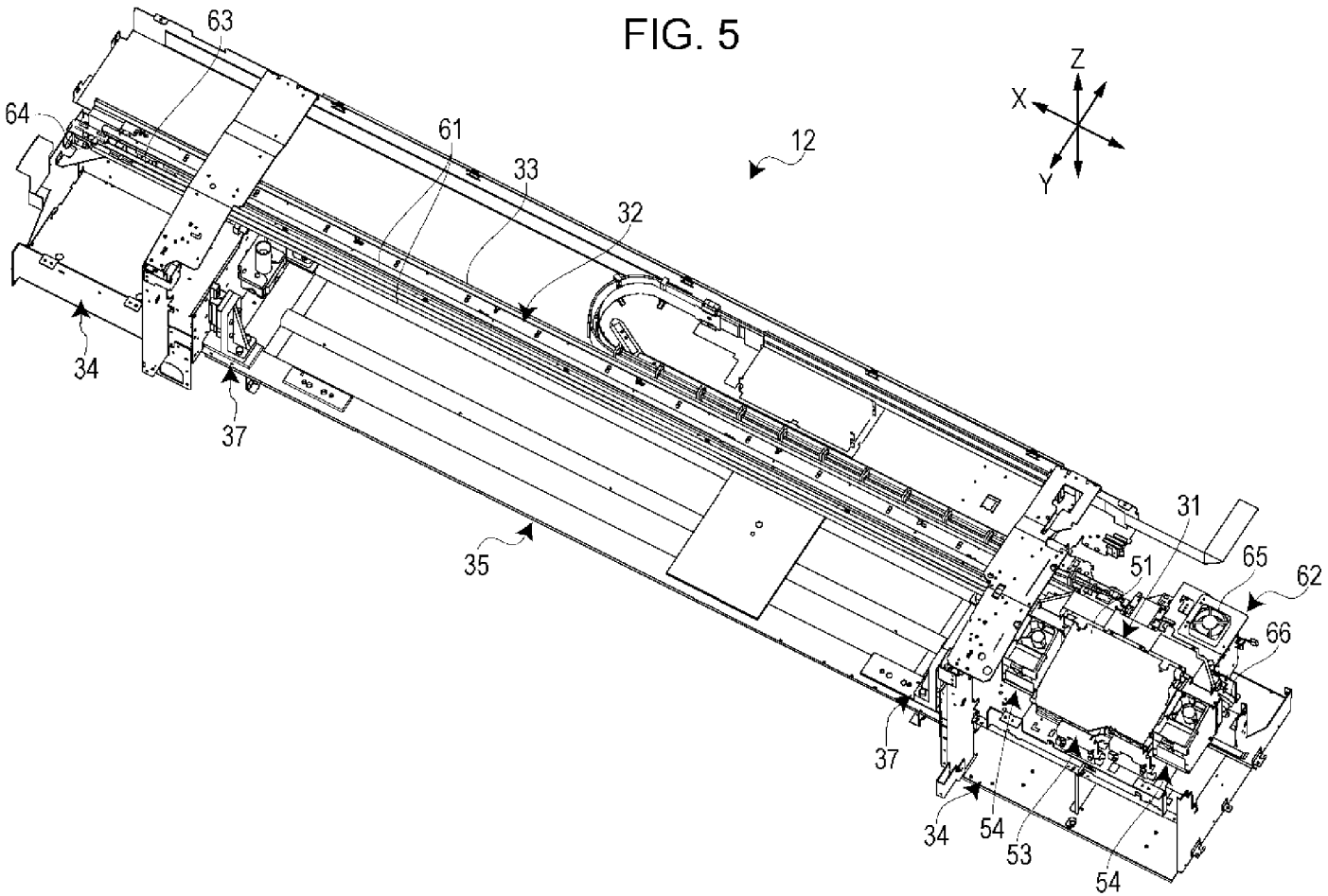
FIG. 5 is a perspective view illustrating a recording processing section that excludes the apparatus cover.
Figure 6:
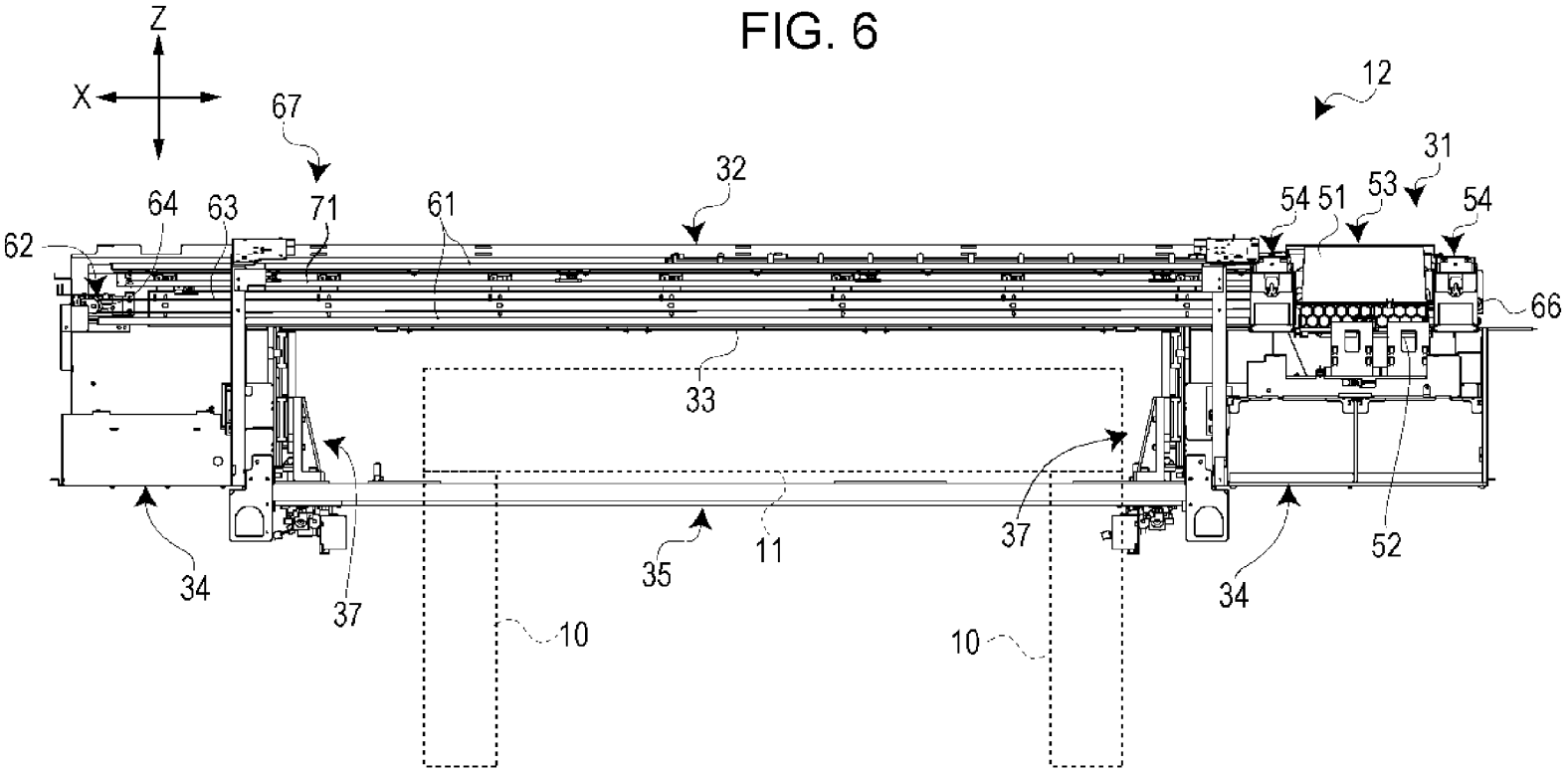
FIG. 6 is a front view illustrating the recording processing section that excludes the apparatus cover.

As shown in FIG. 5 and FIG. 6, the recording processing section 12 includes the head unit 31 confronting the recording medium A, an X axis movement section (movement section) 32 that supports the head unit 31 in the rear side and moves the head unit 31 in the X axis direction, a horizontal rack frame 33 that supports the X axis movement section 32, a pair of side frames 34 that support both sides of the horizontal rack frame 33 from side to side in the X axis direction, a link frame 35 that is linked with each other between base sides of the pair of the side frames 34, and an apparatus cover 36 that covers them (see FIG. 1).

The horizontal rack frame 33 is extended in the X axis direction so as to cross over the support stage 11. Each side frame 34 is extended to a bottom of the support stage 11, and the link frame 35 is linked to both lower end portions of the side frames 34 on a bottom side than the support stage 11. Moreover, an ascending and descending movement section 37 that moves the head unit 31 up and down, through the horizontal rack frame 33 and the X axis movement section 32, is included in each side frame 34. By the ascending and descending movement section 37, the head unit 31 is made close and distant with respect to the support stage 11 and the recording medium A in the upper and lower direction (gap adjustment).

As shown in FIG. 4, the Y axis movement section 13 is arranged between the support stage 11 and the link frame 35, and moves the recording processing section 12 in the Y axis direction, with respect to the support stage 11. The Y axis movement section 13 includes a pair of linear guide mechanisms 86 that are arranged on both sides of the back side of the support stage 11 in the left and right direction and slides the recording processing section 12 in the Y axis direction with respect to the support stage 11, a Y axis movement mechanism 87 that is arranged in the center of the back side of the support stage 11 and moves the recording processing section 12 in the Y axis direction with respect to support stage 11, and a drive motor 88 that drives the Y axis movement mechanism 87. Each linear guide mechanism 86 is configured by a LM guide (a registered trademark) mechanism. In addition, the Y axis movement mechanism 87 is configured by a ball screw mechanism.

Figure 7:
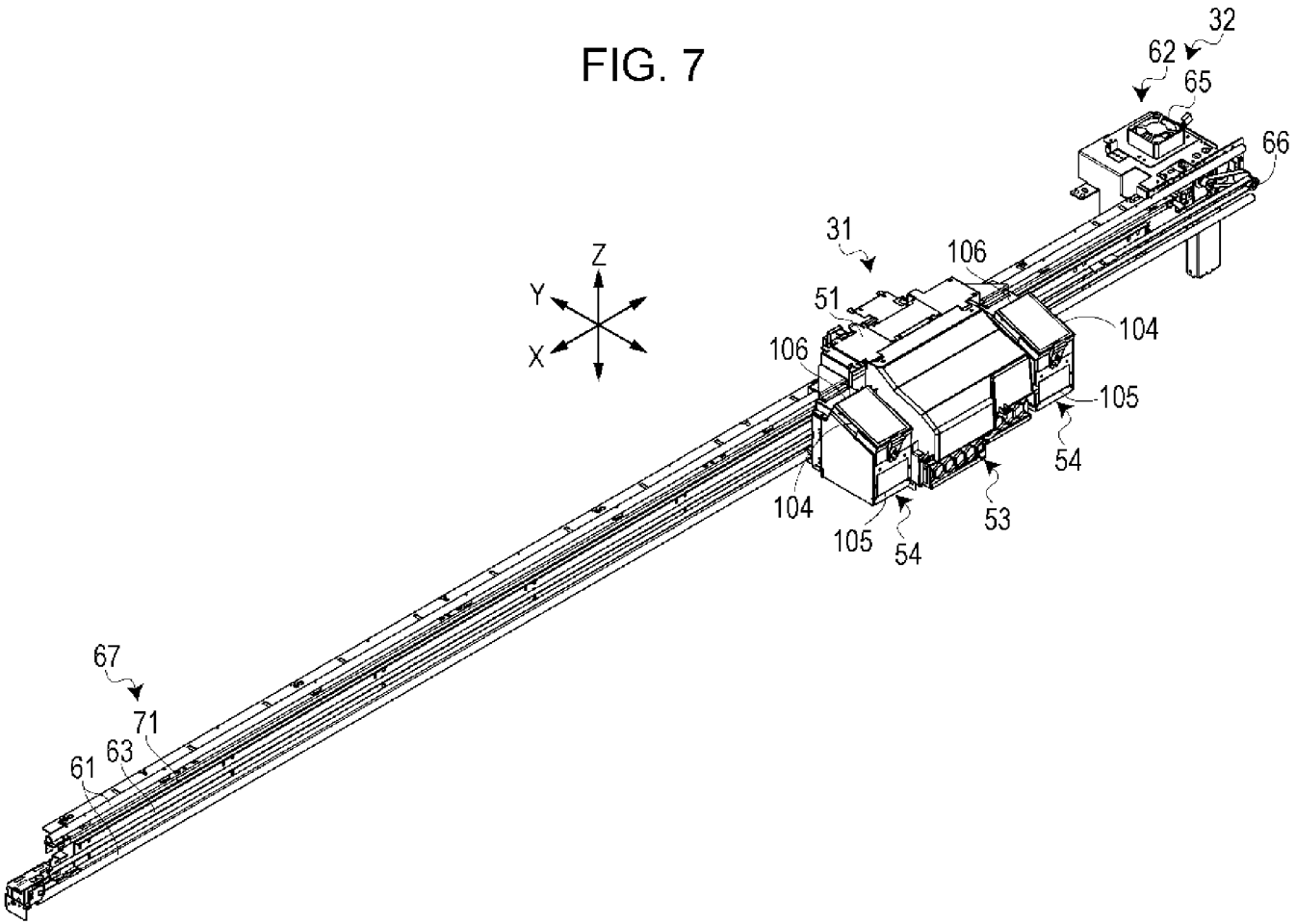
FIG. 7 is a perspective view illustrating a head unit and the vicinity of an X axis movement section.

Here, referring to FIG. 5 to FIG. 9, the head unit 31 and the X axis movement section 32 will be described. As shown in FIG. 5 to FIG. 7, the X axis movement section 32 includes a pair of guide shafts 61 that is supported by the horizontal rack frame 33 and supports the head unit 31 reciprocatably up and down in the X axis direction, an X axis drive mechanism 62 that drives the head unit 31 in a direct acting manner along with the pair of the guide shafts 61, and an X axis detection mechanism 67 that detects a movement position of the head unit 31 in the X axis direction.

The X axis drive mechanism 62 includes a timing belt 63 that is extended in the X axis direction along with the pair of the guide shafts 61, a main driving pulley 66 and a driven pulley 64 that are laid across the timing belt 63, a link fixing section (not shown) that is linked with each other between the timing belt 63 and the head unit 31, and a carriage motor 65 that drives the main driving pulley 66. In the X axis movement section 32, by rotating the carriage motor 65 in a normal direction and a reverse direction, the head unit 31 reciprocates on the pair of the guide shafts 61 in the X axis direction through the timing belt 63.

Figure 10:
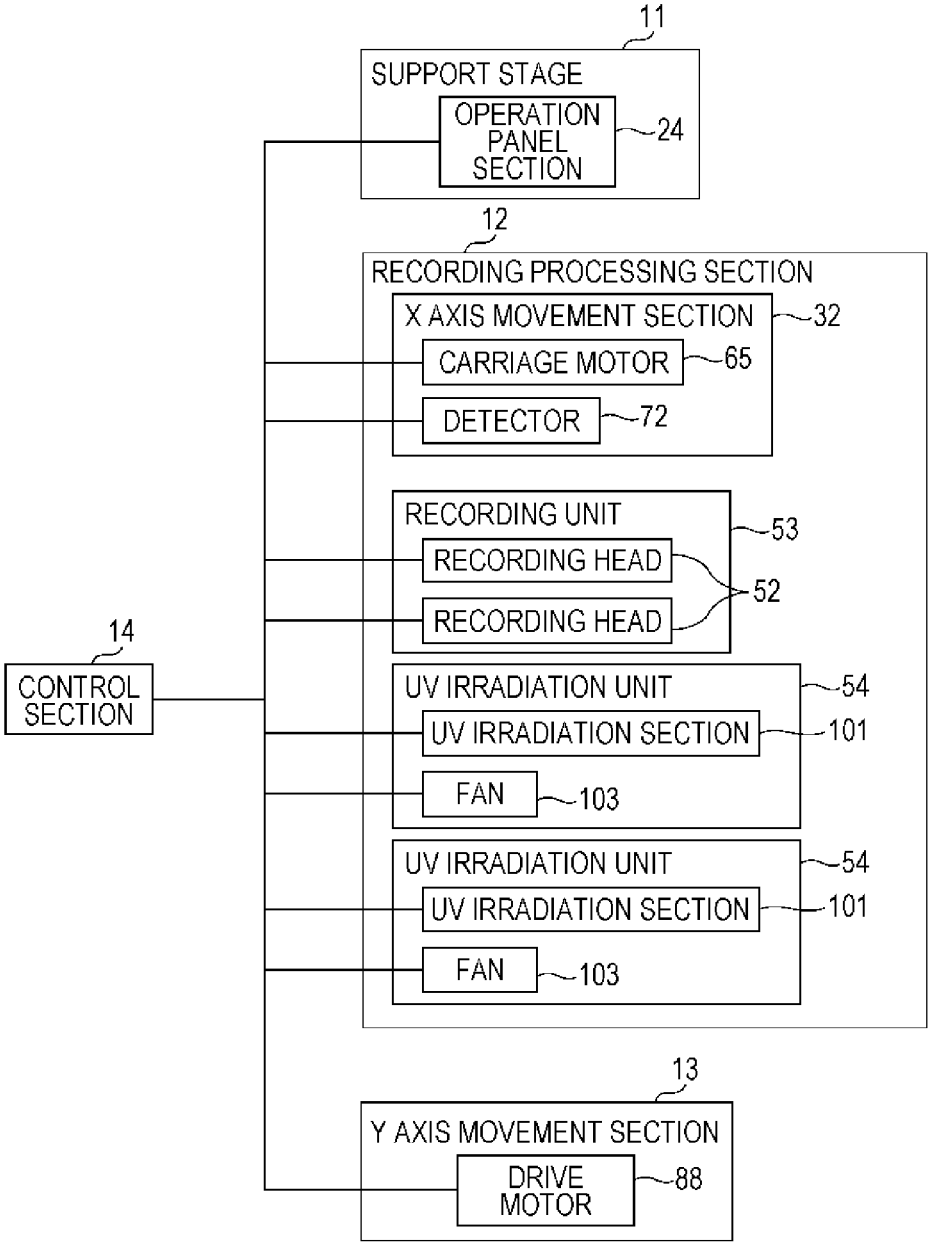
FIG. 10 is a control block diagram illustrating a control configuration of the recording apparatus.

The X axis detection mechanism 67 includes a linear scale 71 that is arranged along the X axis direction, and a detector 72 that is fixed to the head unit 31 and detects the movement position of the head unit 31 by reading graduations of the linear scale 71 (see FIG. 10).

As shown in FIG. 6 and FIG. 7, the head unit 31 has a recording unit (liquid discharge section) 53 that is loaded with two recording heads 52 on a box type carriage 51, and a pair of UV irradiation units (intake and exhaust section) 54 that are arranged to be adjacent from side to side, respectively, with respect to the recording unit 53. The recording unit 53 and the pair of the UV irradiation units 54 are individually supported by the pair of the guide shafts 61, in the rear side thereof. Furthermore, the recording unit 53 and the pair of the UV irradiation units 54 are configured to move together by the X axis movement section 32.

Each recording head 52 is an ink jet head that is driven to discharge by a piezoelectric element (piezo element), and has plural nozzle arrays (not shown) of each color that are extended in the Y axis direction. That is, the recording head 52 is configured to be capable of discharging UV curable inks of plural colors. Furthermore, the two recording head 52 face the recording medium A with nozzle surfaces thereof, respectively, and discharge the ink downward. In the embodiment, the ink jet head in a piezo manner is used, but is not limited thereto. For example, the ink jet head in a thermal manner or in an electrostatic manner may be used. Moreover, the ink jet head is not limited to an on-demand type ink jet head, and a continuous type ink jet head may be used.

Figure 8A:
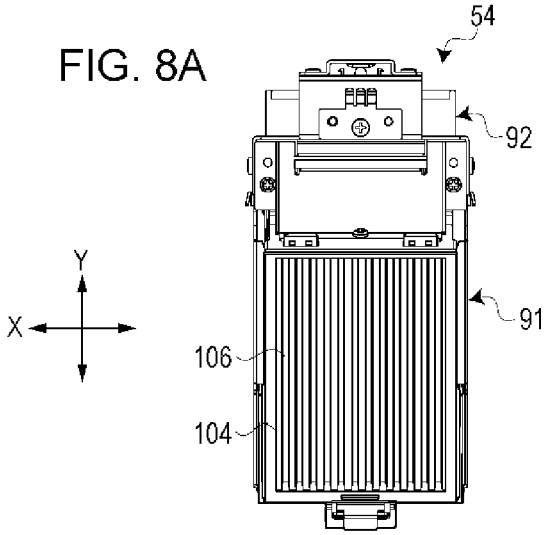
FIG. 8A is a plan view illustrating a UV irradiation unit.
Figure 8B:
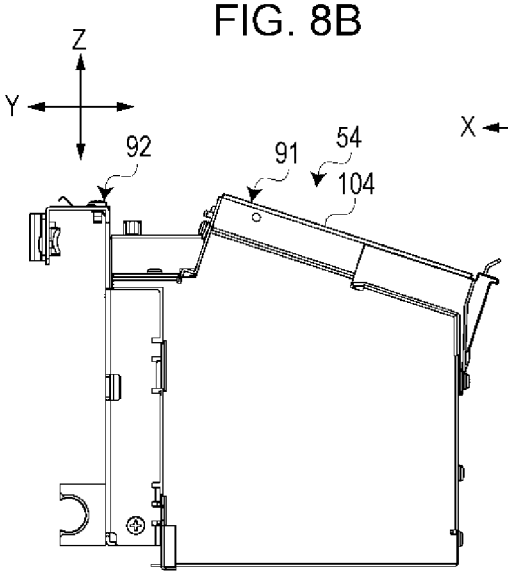
FIG. 8B is a side view illustrating the UV irradiation unit.
Figure 8C:
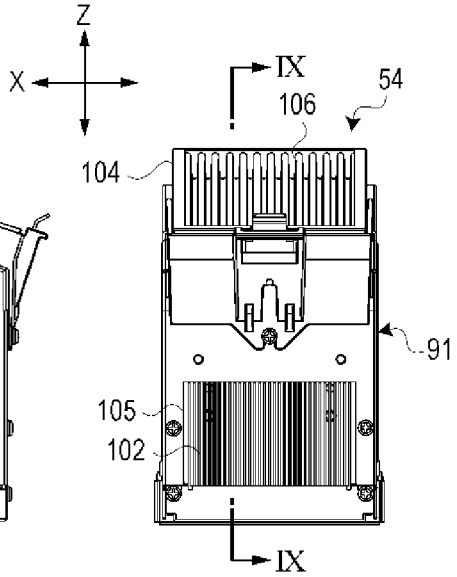
FIG. 8C is a front view illustrating the UV irradiation unit.
Figure 9:
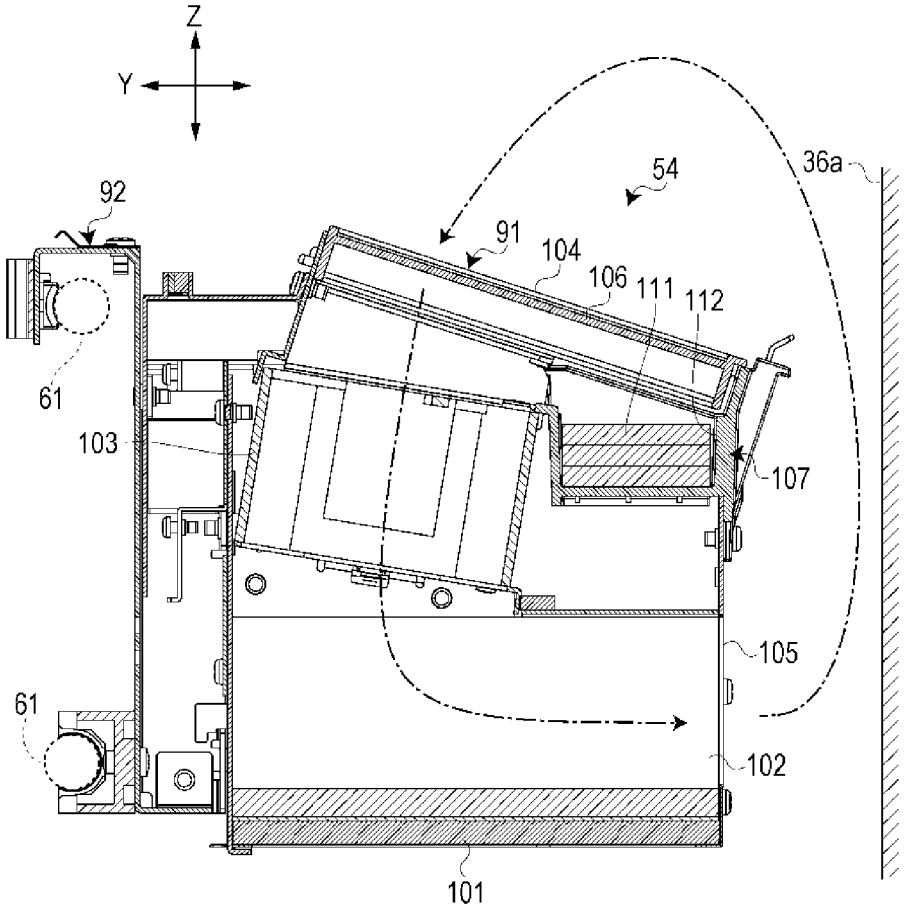
FIG. 9 is a sectional view illustrating the UV irradiation unit taken along the line IX-IX.

As shown in FIG. 8A to FIG. 9, each UV irradiation unit 54 includes a main body of irradiation unit 91, and a mounting member 92 that is arranged in the rear side of the main body of irradiation unit 91 and mounted to be capable of sliding the main body of irradiation unit 91 on the pair of the guide shafts 61.

The main body of irradiation unit 91 includes an UV irradiation section (electromagnetic wave irradiation section) 101 confronting the recording medium A, a fin type heat sink 102 that is arranged in an upper portion of the UV irradiation section 101 and cools the UV irradiation section 101, a fan 103 for cooling that is arranged on an upper side of the heat sink 102 and generates an air flow through the heat sink 102, and an intake port 104 and an exhaust port 105 that perform an intake and an exhaust being arranged on the front side of the upper potion and the lower portion. The UV irradiation section 101 is configured of plural UV irradiation LEDs that irradiate with the UV (electromagnetic wave), and arranged in the lower portion of the main body of irradiation unit 91 in the lower direction. Each UV irradiation unit 54 cures (fixes) the UV curable ink by irradiating the UV curable ink which is discharged onto the recording medium A by the recording head 52, with the UV, using the UV irradiation section 101.

In addition, the main body of irradiation unit 91 includes a filter (first filter) 106 that is arranged in the intake port 104 and catches an ink mist, and an ink storage section (liquid receiving section: first liquid receiving section) 107 facing (confronting) the lower end portion of the filter 106. An internal flow path having "L" shape which is communicated with the intake port 104 and the exhaust port 105, is formed in the main body of irradiation unit 91. From an upper stream side, the intake port 104, the filter 106, the fan 103, the heat sink 102 and the exhaust port 105 are arranged in order. When the fan 103 is driven, an atmosphere containing the ink mist is sucked from the intake port 104, and is exhausted from the exhaust port 105 through the filter 106 and the heat sink 102. Therefore, the UV irradiation unit 54 also functions as a mist recovery unit which sucks the atmosphere in the vicinity of the recording unit 53 and catches and exhausts the ink mist. The ink mist is generated according to the ink discharging of the recording head 52.

The intake port 104 is arranged in the upper portion of the main body of irradiation unit 91, and is obliquely arranged upward to face the upper direction and the front side direction. That is, the intake port 104 is arranged to be inclined with respect to a horizontal surface. On the other hand, the exhaust port 105 is arranged on the front side of the lower portion of the main body of irradiation unit 91, and is arranged to face the front side. Accordingly, the air flow which flows to the intake port 104 facing the upper direction and the front side direction from the exhaust port 105 facing the front side is generated, out of the UV irradiation unit 54 (see FIG. 9). In other words, the air flow circulating on the front side of the UV irradiation unit 54, is generated. As shown in FIG. 9, a wall surface 36*a* of the apparatus cover 36 faces the exhaust port 105.

The filter 106 is arranged on the intake port 104, and is obliquely arranged to face the upper direction in accordance with the intake port 104. Moreover, the filter 106 is extended forward to the portion right above the ink storage section 107.

The ink storage section 107 is arranged so as to face the lower end portion of the filter 106. The ink storage section 107 has a storing container 111 that receives and stores the ink which is discharged from the lower end portion of the filter 106, and an absorbing member 112 which is filled in the storing container 111. The ink mist is caught by the filter 106, the ink is pooled at the filter 106, the pooled ink is collected in the lower end portion of the filter 106, and then, the ink reaches and is stored in the ink storage section 107.

FIG. 10 is a control block diagram illustrating a control configuration of the recording apparatus 1. As shown in FIG. 10, the control unit 14 is connected to the support stage 11, the recording processing section 12 and the Y axis movement section 13. The control unit 14 receives operation information of a user operation from the operation panel section 24, and receives a detection result (movement position) from the detector 72 of the X axis movement section 32. On the other hand, the control unit 14 controls the carriage motor 65 of the X axis movement section 32, the two recording heads 52 of the recording unit 53, the UV irradiation section 101 and the fan 103 of each UV irradiation unit 54 and the drive motor 88 of the Y axis movement section 13, and performs a recording operation (liquid discharge operation).

In the recording operation, the control unit 14 intermittently moves the recording processing section 12 from the front side to the rear side in a state of driving each fan 103, using the Y axis movement section 13 (new line feed). Therefore, whenever the intermittent movement of the recording processing section 12 is stopped in the Y axis direction, the head unit 31 is moved in the X axis direction using the X axis movement section 32, and the ink is discharged from the recording head 52, while outputting the UV from the UV irradiation section 101 (recording processing). Consequently, the desired image is recorded with respect to the recording medium A. At this time, the pair of the UV irradiation units 54 reciprocate together with the recording unit 53 in the X axis direction, in the state of driving each fan 103, and the ink mist is recovered in the whole area of the recording processing section 12 (inside the apparatus cover 36) in the X axis direction by the pair of the UV irradiation units 54. That is, it is configured to perform a mist recovery operation (intake and exhaust operation), together with the recording operation.

According to the configuration described above, the UV irradiation unit 54 is supported by the X axis movement section 32 on the rear side (one side in the second direction), and the exhaust port 105 of the UV irradiation unit 54 faces the front side (the other side in the second direction). Thereby, it is possible to prevent the exhaust from the UV irradiation unit 54 from reaching the X axis movement section 32. Consequently, it is possible to exceedingly avoid attaching particles of the ink which is not caught by the filter 106 to the X axis movement section 32, riding on the exhaust. Therefore, it is possible to prevent occurring a defect in the X axis movement section 32 by the attaching of the ink. In particular, it is possible to stably detect the movement position of the head unit 31 by the X axis detection mechanism 67, without attaching the ink to the linear scale 71.

Furthermore, the intake port 104 is obliquely arranged upward to face the upper direction and the front side direction, thereby generating the air flow which flows to the intake port 104 facing the upper direction and the front side direction, from the exhaust port 105 facing the front side. That is, it is possible to exceedingly avoid flowing the atmosphere containing the ink mist into the X axis movement section 32 side (rear side), by generating the air flow circulating on the front side. Accordingly, it is possible to effectively prevent the particles of the ink from attaching to the X axis movement section 32.

By arranging the filter 106 obliquely in accordance with the intake port 104, it is possible to effectively catch the ink mist. Additionally, it is possible to improve attaching and detaching properties of the filter 106.

The ink storage section 107 facing the lower end portion of the filter 106 is included while arranging the filter 106 obliquely. Thereby, the ink is stored in the ink storage section 107, and there is no possibility that the filter 106 is saturated with the ink. Consequently, it is possible to reduce an exchange frequency of the filter 106 or a cleaning frequency of the filter 106.

In the embodiment, the fan 103 may be configured to be capable of switching between a normal rotation drive and a reverse rotation drive, and the two fans 103 may be configured to switch between the normal rotation drive and the reverse rotation drive, along with switching of the movement between to the one side and to the other side in the X axis direction of the recording unit 53. Specifically, the control unit 14 switches between the normal rotation drive and the reverse rotation drive so as to drive the fan 103 of the UV irradiation unit 54 which is positioned on the front side than the recording unit 53 in a movement direction in a normal rotation manner, and the fan 103 of the UV irradiation unit 54 which is positioned on the rear side than the recording unit 53 in the movement direction in a reverse rotation manner, along with the switching of the movement direction in the reciprocation of the recording unit 53 from side to side. Therefore, the UV irradiation unit 54 which is positioned on the front side of the recording unit 53 generates the air flow in a forward direction which is sucked from the intake port 104 and is exhausted from the exhaust port 105 by the normal rotation drive of the fan 103, and the UV irradiation unit 54 which is positioned on the rear side of the recording unit 53 generates the air flow in a reverse direction which is sucked from the exhaust port 105 and is exhausted from the intake port 104 by the reverse rotation drive of the fan 103. According to the configuration described above, it is possible to catch the ink mist more largely.

In the configuration described above, the filters 106 are arranged in the intake port 104 and the exhaust port 105, respectively. Furthermore, it is preferable that the filter 106 (second filter) of the exhaust port 105 side is obliquely arranged to face the upper direction and the ink storage section (second liquid receiving section) 107 facing the lower end portion of the filter 106 is arranged therein. According to the configuration described above, by arranging the filters 106 to each of the intake port and the exhaust port, it is possible to catch the ink mist in the upper stream end of the air flow (the air flow in the forward direction and the air flow in the reverse direction), regardless of the normal rotation drive and the reverse rotation drive of the fan. Moreover, since the ink storage section 107 is included while obliquely arranging the filter 106 of the exhaust side to face the upper direction, there is no possibility that the filter 106 of the exhaust side is saturated with ink.

In the embodiment, it is configured to perform the mist recovery operation together with the recording operation, but may be configured to include a mist recovery mode which performs the mist recovery operation without performing the recording operation. Specifically, the control unit 14 switches an execution mode between a recording processing mode (first mode) that performs the mist recovery operation together with the recording operation and the mist recovery mode (second mode) that performs the mist recovery operation without performing the recording operation, according to the user operation. Therefore, in the mist recovery mode, the control unit 14 causes the head unit 31 (the recording unit 53 and the pair of the UV irradiation units 54) to reciprocate in the X axis direction, using the X axis movement section 32, in the state of driving each fan 103 without driving the recording head 52 and irradiating with the UV from the UV irradiation section 101. According to the configuration described above, even when it is not necessary to perform the recording operation, it is possible to perform the recovery of the ink mist on the recording processing section 12.

In the embodiment, it is configured to include the two UV irradiation unit 54 which are adjacent to both of the front side and the rear side of the recording unit 53, but may be configured to include the single the UV irradiation unit 54.

Furthermore, in the embodiment, the UV irradiation unit 54 is configured to function as a mist recovery section, but the mist recovery unit having no UV irradiation function may be configured to be included, instead of the UV irradiation unit 54. More specifically, the mist recovery unit is configured to include the fan 103, the intake port 104, the exhaust port 105, the filter 106 and the ink storage section 107, excluding the UV irradiation section 101 and the heat sink 102 from the UV irradiation unit 54.

In the embodiment, the intake port 104 and the exhaust port 105 are configured to be arranged to face the front side direction, while the recording unit 53 and the UV irradiation unit 54 are supported on the rear side, but may be configured to exhaust to the distant side from the X axis movement section 32. For example, when the recording unit 53 and the UV irradiation unit 54 are supported on the front side, the intake port 104 and the exhaust port 105 are arranged to face the rear side direction.

Moreover, in the embodiment, the intake port 104 is configured to be obliquely arranged to face the upper direction, but for example, the intake port 104 may be configured to be arranged to face the front and rear direction, the upper direction or the left and right direction.

In the embodiment, the exhaust port 105 is configured to be arranged to face the front side direction, but for example, the exhaust port 105 may be configured to be obliquely arranged upward to face the front side direction and the upper direction. That is, the gist of "facing the other side in the front and rear direction" according to the aspect of the invention, is not limited to the configuration to face only the other side, and is a concept including the configuration to be obliquely arranged upward to face the other side direction and the upper direction and the configuration to be obliquely arranged downward to face the other side direction and the lower direction.

Furthermore, in this embodiment, the invention is applied to the recording apparatus 1 that performs the recording by moving the head unit 31 in the X axis direction and the Y axis direction, but it may be configured to apply the invention to the recording apparatus 1 (so-called line printer) that performs the recording by moving the head unit 31 having a line head only in the Y axis direction.

In the embodiment, the X axis direction is a so-called main scanning direction, and the Y axis direction is a so-called sub scanning direction.

Additionally, in the embodiment, the invention is applied to the recording apparatus 1 using the UV curable ink, but the invention may be applied to the recording apparatus 1 using the ink which is cured by irradiating with infrared rays and microwaves, as the recording apparatus 1 using an electromagnetic wave curable ink. Further, the invention is not applied only to the recording apparatus 1 using the electromagnetic wave curable ink, and the invention may be applied to the recording apparatus 1 using the ink such as a general water based ink, an oil based ink, a gel ink and a hot melt ink, as an ink.

In the embodiment, the invention is applied to the recording apparatus 1 that discharges the ink, but the invention may be applied to the liquid discharge apparatus that discharges (or ejects) the liquid (droplet) other than the ink. For example, the invention may be configured to be applied to the liquid discharge apparatus that discharges the liquid (functional liquid) containing in the form of dispersing or dissolving the materials such as electrode material and color material which are used for manufacturing a liquid crystal display, an organic EL (electroluminescence) display, a surface light emitting display, a color filter or the like.

The invention may be applied to the liquid discharge apparatus that discharges the biological organic material which is used for manufacturing a biochip, the liquid discharge apparatus that discharges the liquid of a specimen which is used as a minute pipette, a printing apparatus, a micro dispenser or the like.

Furthermore, the invention may be applied to the liquid discharge apparatus that discharges a lubricating oil at a pin point to precision machines such as a watch and a camera, the liquid discharge apparatus that discharges a transparent resin liquid such as UV curable resin to a substrate in order to form a micro semispherical lens (optical lens) which is used in an optical communication element or the like, and the liquid discharge apparatus that discharges etching solutions such as an acid and an alkali in order to etch the substrate or the like.

As the configuration of discharging the liquid, the configuration of discharging the liquid so as to fly in the granular state, the configuration of discharging the liquid so as to fly in the tear-formed state, the configuration of discharging the liquid so as to fly in the filiform state having a lasting effect, or the like, is assumed.

In addition, if the liquid discharge apparatus can discharge, the liquid material in that case may be used as a liquid. For example, the materials in the flow state such as a liquid body having high or low viscosity, a sol, gel water, other inorganic solvents, an organic solvent, a solution, a liquid resin and a liquid metal (metallic melt), may be used. Not only the liquid as one form of a substance but also the material in which particles of a functional material which is formed of solid materials such as a pigment or a metal particle are dissolved, dispersed or mixed to the solvent, are assumed.

The entire disclosure of Japanese Patent Application No. 2013-068276, filed Mar. 28, 2013 is expressly incorporated by reference herein

What is claimed is:

1. A liquid discharge apparatus comprising:

a liquid discharge section that discharges a liquid;

an intake and exhaust section that has an intake port, an exhaust port, a flow path which is communicated with the intake port and the exhaust port, and a filter which catches the liquid; and a movement section that supports the liquid discharge section and the intake and exhaust section, and moves the liquid discharge section and the intake and exhaust section in a first direction, wherein the intake and exhaust section is supported by the movement section on one side in a second direction which is orthogonal to the first direction, and the exhaust port faces the other side which is opposite to the one side in the second direction, wherein the intake port is arranged in an upper portion of the intake and exhaust section, and arranged to be inclined with respect to a horizontal surface.

2. The liquid discharge apparatus according to claim 1, wherein the filter is obliquely arranged in accordance with the intake port.

3. The liquid discharge apparatus according to claim 2, wherein the intake and exhaust section has a liquid receiving section that receives the liquid which is discharged from a lower end portion in a vertical direction of the filter.

4. The liquid discharge apparatus according to claim 1, wherein the liquid discharge section discharges the liquid of an electromagnetic wave curing type onto a medium, the intake and exhaust section has an electromagnetic wave irradiation section that irradiates with the electromagnetic wave to the liquid which is discharged onto the medium, and a heat sink that cools the electromagnetic wave irradiation section, and the heat sink is arranged between the filter and the exhaust port in the flow path.

5. The liquid discharge apparatus according to claim 1, wherein the filter has a first filter which is arranged in the intake port, and a second filter which is arranged in the exhaust port, and the intake and exhaust section has a first liquid receiving section that receives the liquid which is discharged from the lower end portion in the vertical direction of the first filter, and a second liquid receiving section that receives the liquid which is discharged from the lower end portion in the vertical direction of the second filter.

6. A liquid discharge apparatus comprising:

a liquid discharge section that discharges a liquid;

an intake and exhaust section that has an intake port, an exhaust port, a flow path which is communicated with the intake port and the exhaust port, and a filter which catches the liquid; and a movement section that supports the liquid discharge section and the intake and exhaust section, and moves the liquid discharge section and the intake and exhaust section in a first direction, wherein the intake and exhaust section is supported by the movement section on one side in a second direction which is orthogonal to the first direction, and the exhaust port faces the other side which is opposite to the one side in the second direction, wherein the intake and exhaust sections are included on one side and the other side of the liquid discharge section in the first direction, the two intake and exhaust sections include a fan configured to be capable of switching between a normal rotation drive that generates an air flow in a forward direction in an intake and an exhaust and a reverse rotation drive that generates the air flow in a reverse direction in the intake and the exhaust, respectively, and the two fans switch between the normal rotation drive and the reverse rotation drive so as to drive the fan of the intake and exhaust section which is located on a front side than the liquid discharge section in the first direction in a normal rotation manner, and the fan of the intake and exhaust section which is located on a rear side than the liquid discharge section in the first direction in a reverse rotation manner, along with switching of the movement between to the one side and to the other side in the first direction of the liquid discharge section.

7. A liquid discharge apparatus comprising:

a liquid discharge section that discharges a liquid;

an intake and exhaust section that has an intake port, an exhaust port, a flow path which is communicated with the intake port and the exhaust port, and a filter which catches the liquid;

a movement section that supports the liquid discharge section and the intake and exhaust section, and moves the liquid discharge section and the intake and exhaust section in a first direction; and a control section that switches between a first mode which performs a liquid discharge operation to discharge the liquid from the liquid discharge section and an intake and exhaust operation to drive the intake and exhaust section, and a second mode which does not perform the liquid discharge operation and performs the intake and exhaust operation, wherein the intake and exhaust section is supported by the movement section on one side in a second direction which is orthogonal to the first direction, and the exhaust port faces the other side which is opposite to the one side in the second direction.

* * * * *